United States Patent [19]

Head et al.

[11] 3,995,239

[45] Nov. 30, 1976

[54] TRANSITION APPARATUS

[75] Inventors: Manley J. Head, Garland; Frank E. Reisch, Rockwall, both of Tex.

[73] Assignee: Rockwell International Corporation, El Segundo, Calif.

[22] Filed: Sept. 8, 1975

[21] Appl. No.: 611,285

[52] U.S. Cl. ..... 333/21 R; 333/84 M

[51] Int. Cl.[2] ..... H01P 1/16; H01P 3/08

[58] Field of Search ..... 333/21 R, 26, 84 R, 333/84 M

[56] References Cited

UNITED STATES PATENTS

| | | | |
|---|---|---|---|
| 3,678,395 | 7/1972 | Hunton et al. | 333/84 M X |
| 3,735,267 | 5/1973 | Napoli | 333/84 R X |
| 3,769,617 | 10/1973 | West | 333/84 R |
| 3,835,421 | 10/1974 | DeBrecht et al. | 333/26 |
| 3,842,360 | 10/1974 | Dickens | 333/84 M X |

*Primary Examiner*—Paul L. Gensler

*Attorney, Agent, or Firm*—Bruce C. Lutz; Robert J. Crawford

[57] ABSTRACT

A transition for coupling coplanar transmission means to slotline transmission means wherein the balanced slotline can efficiently be coupled to unbalanced signal supplying means such as coax cable. The transition comprises a terminating means for reacting or interacting with the end of a slotline. This interaction between the end of a coplanar signal transmission means and the slotline means allows transmission of signals in either direction between the slotline and the coplanar sections.

16 Claims, 6 Drawing Figures

TRANSITION APPARATUS

THE INVENTION

This invention is generally related to electronic signal couplers and more specifically to a transition for interaction between a balanced slotline transmission means and an unbalanced coplanar line signal transmission means.

As is known to those skilled in the art, a transition element, according to the definition used by the Institute of Electrical and Electronic Engineers is a device used to couple one type of transmission system to another type for the purpose of transmitting signal energy therethrough. As an example, coupling a coax line to a waveguide. In one sense of the word, a transition element acts as an impedance matching transformer.

While there are many types of transition means, there are not to our knowledge, any types of transitions between coplanar and slotline transmission means. Furthermore, the prior art transitions to slotlines from other transmission means have been difficult and/or expensive to consistently manufacture. One such prior art transition from coax to slotline is to solder the shielding cable of a coax line to the ground plane at one end of a slotline and to solder or otherwise electrically attach the central conductor to the ground plane on the other side of the slotline at the same end, so as to form a coupling loop. The dimensions and positioning used are somewhat critical and it has been found that it is difficult to obtain repeatable results upon commercial manufacture of such a connection. Further, the bandwidth can be somewhat narrow, as compared to the present invention and is difficult to enclose. Further, the coupling loop inductance limits the high frequency performance.

Another prior art transition is to couple microstrip to slotline with the coax being connectable to microstrip. This method utilizes the microstrip and the slotline on opposite sides of a substrate. Certain variations of this approach require the drilling of a hole thus requiring an added manufacturing step.

The present invention utilizes a coplanar transmission means to slotline transition means. There are standard connectors available which will permit the connection of coax to the coplanar transmission means and thus the slotline can be readily connected to a coax connector. One such connector is an OSM244-6 by Omni Spectra, Inc,. of Farmington, Michigan 48024. The transition comprises a terminating means for the slotline with an interacting element between the slotline and the terminating means which interacting element electromagnetically couples signals between the slotline and the coplanar transmission means. Ground current equalizing means are required adjacent the end of the slotline and the termination means for optimum performance.

Therefore, objects of the present invention are to provide a transition from coplanar line to slotline which has a broad bandwidth and is economical to manufacture.

Other objects and advantages may be ascertained from a reading of the specification and appended claims in conjunction with the drawings wherein:

Figure 1:
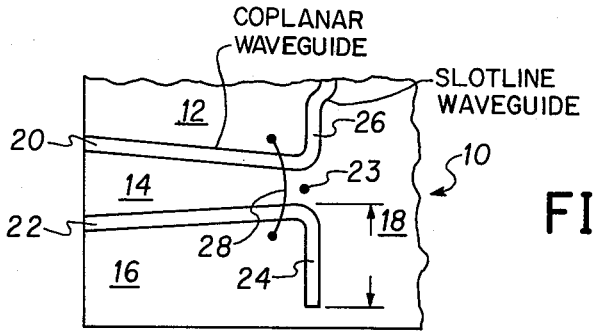
FIG. 1 is a pictorial view of a portion of a substrate illustrating a coplanar signal transmission means extending to the edge of the substrate with a slotline transmission means extending into the substrate circuit area.

In FIG. 1, a substrate generally designated as 10 has a conductive ground plane portion generally covering the entire surface of one side of the substrate. However, the conductive portion is designated as 12, 14, 16 and 18 for discussion purposes. The conductive portions 12, 14, 16 and 18 are generally attached to a ceramic or other dielectric substrate which can be seen in the clear areas of or openings in the ground plane such as in paths 20 or 22. A further cleared area, opening, or path 24 comprises a termination means, in the form of a short circuit shunt stub and a final cleared path 26 represents the slotline transmission line means. An interacting element or coupling means 23 electromagnetically couples the signal energy from the coplanar transmission line to the slotline transmission line. A ground current equalizing means or wire 28 is connected from ground plane conductive element 12 to ground plane conductive element 16. As illustrated, FIG. 1 represents the bottom left hand corner of a substrate and the broken areas represent the remaining portions of the substrate which contain other electrical components and circuit paths. A slotline 26 would be connected to some other component for the purpose of transmitting signals to or from the outside world via the transition represented in FIG. 1 to the coplanar transmission section and hence to a coaxial connector or other means of transmitting signals to the outside world.

As illustrated, FIG. 1 contains a pair of arrows defining the length of the short circuit shunt stub 24. This arrow defined distance must be $\lambda/2$ above a signal having the highest transmission frequency of interest. Further, the impedance that the stub 24 presents at the transition point 23 must be much greater than the characteristic impedance of the slotline transmission line 26 for broadband performance.

Figure 2:
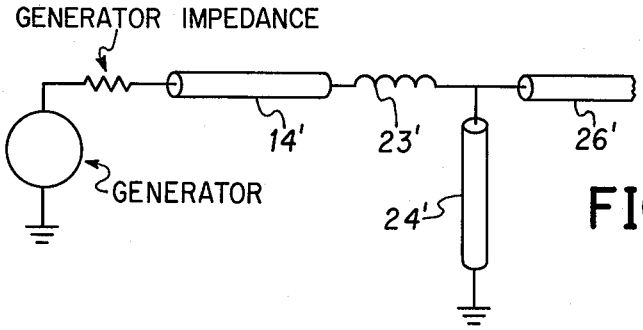
FIG. 2 is a simplified model representative of the transition disclosed.

As previously indicated, FIG. 2 is a simplified model of a transition such as that illustrated by FIG. 1. In this model, the components corresponding to components in FIG. 1 are given the same number with the addition of a prime. It will additionally be noticed that there is a generator and a resistance labeled generator impedance. This, of course, would be the source of electrical signals. Although to this point, all description has been on the basis of transmission from the outside world through a coplanar line transmission line to a slotline transmission line, the apparatus as illustrated is bidirectional, (i.e., the generator of FIG. 2 could be a signal sink). All of the rest of the inventive representations of FIGS. 3–6 are also bilateral or bidirectional in operation and the remaining descriptions of one direction of operating are not intended to be limiting. As will be apparent, the item 14′ is representative of the coplanar line while the inductance 23′ is intended to represent the inductance of the coupling element. The item 24′ represents the high impedance of the shunt stub to the slotline and item 26′ represents the slotline transmission means.

The upper frequency limit of the device is determined by the length of the high impedance slotline shunt stub or termination 24′. At a frequency where the termination means 24 electrically is effectively $\lambda/2$ long, a short circuit will be reflected at the juncture of the coplanar line 14 and the slotline 26, thus setting the practical upper frequency limit. Below this frequency the impedance of the shunt stub will be high compared to the impedance of the main transmission elements 14 and 26 until a low frequency is reached where the termination means 24 (shunt stub) behaves as an inductor whose reactance eventually becomes very low compared to the main transmission means.

Figure 3:
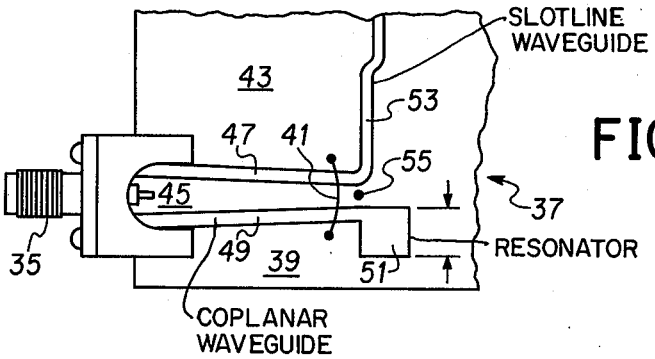
FIG. 3 illustrates a termination means different from that of FIG. 1 and also illustrates a form of connection of a commercial coax connector to the coplanar transmission means.

In FIG. 3, a coax connector generally designated as 35 is connected to a substrate generally designated as 37 having ground plane 39 electrically connected via a ground current equalizing wire or strap 41 to a ground plane 43. A section 45 is the central conducting element of an unbalanced coplanar signal transmission line means and the clear areas 47 and 49 provide a dielectric spacing or insulation from the ground planes 39 and 43 on either side. Area 55 of the transition acts as an interacting element wherein the signals in one of the transmission means are electromagnetically coupled to the other transmission means. This circuit behaves somewhat similarly to that of FIG. 1, except the high impedance shunt transmission line shorted stub is replaced by a rectangular shaped resonator. In this case, the dimensions of the resonator (as shown by the arrows) must be chosen so that the Transverse Electric ($TE_{MN}$) and Transverse Magnetic ($TM_{MN}$) mode resonances are above the highest transmission frequency of interest. At frequencies corresponding to those below the lowest resonance mode ($TE_{11}$), the termination presents a high impedance until a frequency is reached where the distance around the perimeter of the termination is small compared with a wavelength and at that frequency the termination appears as a short circuit.

Figure 4:
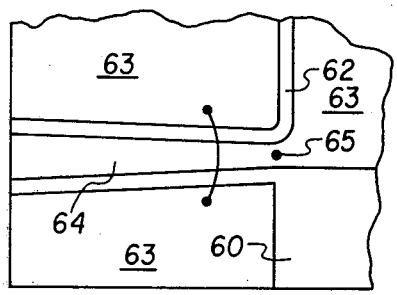
FIGS. 4 and 5 illustrate other possible configurations of the termination portion of the transition.

In FIG. 4, a further embodiment of the inventive concept is illustrated wherein the termination means 60 is a non-resonant open circuit. In this Figure, the ground plane means is designated as 63 while the central conductive element of the coplanar transmission line means is designated as 64 with the coupling means being designated 65.

Figure 5:
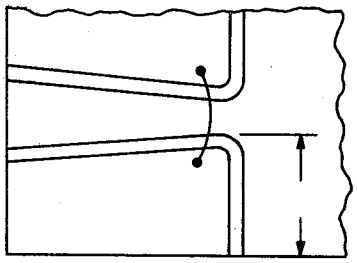

FIG. 5 illustrates a further version of the transition wherein the termination is accomplished using an open circuit stub. The distance defined by the arrows must be $\lambda/4$ above a signal having the highest transmission frequency of interest for optimum performance. Below this frequency, this open circuit stub provides a high impedance over the transmission frequency range used.

Figure 6:
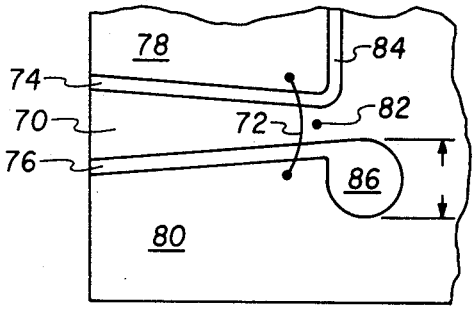
FIG. 6 is a pictorial view illustrating a preferred embodiment of the coplanar to slotline transition.

While FIGS. 1, 3, 4 and 5 disclose operable embodiments of our concept, manufacturing difficulties therein designate FIG. 6 as the preferred embodiment of the transition, whereby the termination 86 is provided by a circular resonator. As described for the circuit of FIG. 2, the circle diameter (shown by the arrows) must be chosen such that the TE and TM mode resonances occur above the highest frequency of interest.

In operation, a signal is passed to the unbalanced coplanar line via a signal inputting means. This signal inputting means may be a standard coaxial connector as previously described or any other such means. Since many types of electrical connections are already known to coplanar signal transmission means, no further illustrations are deemed necessary. The signal is passed to the right along conductive element 70 which is electrically isolated from ground planes 78 and 80 until it reaches the right hand portion adjacent the section 82. As it is passed beneath the ground current equalizing means 72, there is an interaction by a bidirectional coupling element 82 which in combination with the high effective impedance of termination means 86 introduces the signal to the edges of the slotline transmission means 84. The diameter of means 86 is determined as follows:

$$\lambda_o = \frac{d\pi \quad \epsilon_{eff}}{1.84}$$

where $\lambda_o$ = the wavelength corresponding to the $TE_{11}$ mode resonance of the circular resonator termination;

$d$ = the diameter of the resonator, and $\epsilon_{eff}$ = the effective dielectric constant of the dielectric in the vicinity of the resonator. (Note: $\lambda_o$ must be less than $\lambda_{max}$ where $k/\lambda_{max}$ is the highest operating frequency of interest. In the equation given, the frequency will be in gigacycles, $d$ is in inches and $k$ is 11.81).

The arrows in FIG. 6 define a dimension which must be such that $TE_{mn}$ and $TM_{mn}$ resonance modes are above the highest transmission frequency of interest. More information as to the problems associated with the coupling solved by the present invention may be obtained from various background articles such as that written by J. B. Knorr entitled "Slotline Transition" appearing from pages 548–554 of the IEEE Transactions on Microwave Theory and Techniques, May 1974. Information as to the TE and TM modes may be found in a book entitled "Principles and Applications of Waveguide Transmission" authored by G. C. Southworth and published by D. Van Nostrand Company, copyrighted 1950. An article in IEEE-MTT February 1972, pages 172–174 entitled "Slotline Field Components" by Seymour Cohn also contains information pertinent to the electromagnetic modes which propagate in slotline.

As indicated above, FIG. 6 most closely represents the optimum embodiment presently known to the inventors. However, it is to be realized that other embodiments such as in the other Figures will satisfactorily provide the required transition for many applications. Further, other resonator geometry may be used to provide the appropriate impedances. Thus, we wish to be restricted only by the scope of the appended claims.

What is claimed is:

1. Signal transition means comprising, in combination:

insulating substrate means;

slotline signal transmission line means including a first end on a given surface of said substrate means;

coplanar signal tranmission line means having a further end and including ground plane means on said given surface, the axial alignment of said further end being orthogonal said first end;

termination means, on said given surface, for providing a high impedance to signals to be transmitted from one of said transmission line means to and through the other of said transmission line means;

coupling means, on said given surface adjacent the juncture of said slotline transmission line means, said coplanar signal transmission line means, and said termination means for coupling electrical signals from one transmission line means to the other; and ground current equalizing means directly electrically connecting the ground plane means from one side of the coplanar signal transmission line means to the other side at an end adjacent said slotline means.

2. Apparatus as claimed in claim 1 wherein said termination means is a short circuited transmission line resonator.

3. Apparatus as claimed in claim 1 wherein said termination means is rectangular.

4. Apparatus as claimed in claim 1 wherein said termination means is circular.

5. Apparatus as claimed in claim 1 wherein said termination means is an open circuit.

6. The method of converting between a slotline signal transmission medium and a coplanar signal transmission medium comprising the steps of:

electrically terminating the junction of a slotline signal transmission line means and a coplanar line signal transmission line means with a high impedance;

positioning one end of said coplanar signal transmission line means central conductor so that said one end thereof is substantially orthogonal said slotline signal transmission means;

equalizing ground current at said one end of said coplanar signal transmission means; and electrically coupling said slotline signal transmission line means to said coplanar signal transmission line means.

7. Apparatus for electrically connecting coplanar transmission line means to slotline transmission line means on the same surface of an insulating substrate for transmission of electrical signals therethrough comprising, in combination:

ground plane means on said same surface of said substrate;

coplanar transmission means for transmitting electrical signals through said ground plane means on said given surface of said substrate;

slotline transmission line means situated in said ground plane means with one end adjacent to and orthogonal one end of said coplanar transmission line means; and transformer means intermediate said one end of said coplanar means and said one end of said slotline means for transforming signal energy received from one to be supplied to the other, said transformer means including ground current equalizing means directly electrically connecting the ground plane means from one side of the coplanar signal transmission line means to the other side at said one end thereof.

8. Transition means comprising, in combination:

ground plane means;

slotline signal transmission means comprising a path through said ground plane means from a first end to a second end;

coplanar signal transmission means comprising a conductive element juxtaposed and spaced from said ground plane means on both sides and having at least a first end adjacent said first end of said slotline signal transmission means;

termination means spaced from said first end of said slotline signal transmission means by an extension of said conductive element at said first end of said coplanar signal transmission means, an imaginary extension of said slotline means at said first end thereof intersecting said termination means; and ground current equalizing means directly electrically connecting the ground plane means from one side of the coplanar signal transmission means to the other side at said first end thereof.

9. Apparatus as claimed in claim 8 wherein said termination means is generally circularly shaped.

10. Apparatus as claimed in claim 8 wherein said ground current equalizing means is a wire one end of which is juxtaposed said termination means.

11. The method of coupling a coplanar signal transmission means to a slotline signal transmission means for passing electrical signals from one to the other comprising the steps of:

juxtaposing one end of a slotline signal transmission means and an electrical signal termination means effective to appear to said slotline means as a high impedance wherein the one end of said slotline signal transmission means is orthogonal one end of a coplanar signal transmission means on a single surface, and equalizing the ground currents on said surface on both sides of said one end of said coplanar signal transmission means.

12. Apparatus for coupling a coplanar signal transmission means to a slotline signal transmission means for passing signals from one to the other comprising in combination:

means for juxtaposing one end of a slotline signal transmission means, an electrical signal termination means effective to appear to said slotline means as a high impedance open circuit and one end of a coplanar signal transmission means wherein said ends of said slotline means and said coplanar means are orthogonal, and means for equalizing the ground currents on both sides of said one end of said coplanar signal transmission means.

13. Transmission system transition means comprising, in combination:

first means including a dielectric base and a ground plane on at least one face of the base;

coplanar signal transmission means comprising a conductive strip intermediate and spaced from said ground plane thereby forming first and second elongated openings of said dielectric base;

termination means comprising a closed enlargement of one end of said first elongated opening;

slotline signal transmission means comprising an open path of said dielectric base between areas of said ground plane and commencing at one end of said second elongated opening of said dielectric base and adjacent said termination means, and ground current equalizing means electrically connecting the ground plane on either side of said coplanar signal transmission means juxtaposed said slotline signal transmission means.

14. Apparatus as claimed in claim 13 comprising, in addition:

coaxial line signal transmission means including a central conductor and shield means, and means connecting said central conductor to the intermediate conductive strip of said coplanar signal transmission means and said shield means to said ground plane.

15. Apparatus for electrically connecting coplanar transmission line means to slotline transmission line means on the same surface of an insulating substrate for transmission of electrical signals therethrough comprising, in combination:

ground plane means on said same surface of said substrate;

coplanar transmission line means for transmitting electrical signals through said ground plane means on said given surface of said substrate;

slotline transmission line means situated in said ground plane means with one end adjacent to and orthogonal one end of said coplanar transmission line means; and transformer means intermediate said one end of said coplanar means and said one end of said slotline means for transforming signal energy received from one to be supplied to the other, said transformer means including termination means for providing a high impedance to the signal being received from said coplanar transmission line means.

16. Apparatus for converting between slotline signal transmission medium means and coplanar signal transmission medium means comprising, in combination:

means for electrically terminating the junction of the slotline signal transmission line means and a coplanar line signal transmission line means with a high impedance;

means for positioning a central conductor of one end of said coplanar signal transmission line means so that said one end thereto is substantially orthogonal said slotline signal transmission line means;

means for equalizing ground current at one end of said coplanar signal transmission line means; and means for electrically coupling said slotline signal transmission line means to said coplanar signal transmission line means.

* * * * *

UNITED STATES PATENT OFFICE

CERTIFICATE OF CORRECTION

PATENT NO. : 3,995,239

DATED : November 30, 1976

INVENTOR(S) : Manley J. Head and Frank E. Reisch

It is certified that error appears in the above-identified patent and that said Letters Patent are hereby corrected as shown below:

Column 4, line 15, delete "$\frac{\lambda_o = d\pi \varepsilon_{eff}}{1.84}$" and substitute therefor:

-- $\frac{\lambda_o = d\pi \sqrt{\varepsilon_{eff}}}{1.84}$ --

Signed and Sealed this

Eighth Day of February 1977

[SEAL]

*Attest:*

RUTH C. MASON
*Attesting Officer*

C. MARSHALL DANN
*Commissioner of Patents and Trademarks*